United States Patent [19]

Lathers

[11] Patent Number: 4,869,551

[45] Date of Patent: Sep. 26, 1989

[54] MODULAR SEAT FOR RECREATIONAL BOATS

[76] Inventor: Michael W. Lathers, 423 Hawk High Hill Dr., Metamora, Mich. 48455

[21] Appl. No.: 217,583

[22] Filed: Jul. 11, 1988

[51] Int. Cl.[4] ..... A47C 7/00

[52] U.S. Cl. ..... 297/443; 114/363; 297/445

[58] Field of Search ..... 297/443, DIG. 2, 445; 114/363

[56] References Cited

U.S. PATENT DOCUMENTS 2,815,067 12/1957 Richardson ..... 297/443

4,365,840 12/1982 Kehl et al. ..... 297/443

4,722,706 2/1988 Young ..... 114/363 X 4,744,603 5/1988 Knoblock ..... 297/DIG. 2

*Primary Examiner*—James T. McCall

[57] ABSTRACT

A marine vehicle comprising a hull, a deck supported by the hull, and a seat including an L-shaped bracket including a generally horizontal portion having an upper surface, and a generally vertical portion having a front surface, a seat bottom member including a bottom surface connected to the upper surface of the horizontal portion, a seat back member including a back surface connected to the front surface of the vertical portion, and a mechanism for mounting the bracket on the deck.

8 Claims, 2 Drawing Sheets

MODULAR SEAT FOR RECREATIONAL BOATS

RELATED APPLICATION

Attention is directed to U.S. Ser. No. 216,808, filed July 8, 1988, titled "Convertible Bolster/Seat for Recreational Boats" and assigned to the assignee hereof.

BACKGROUND OF THE INVENTION

The invention relates to recreational boats, and, more particularly, to seats for such boats.

SUMMARY OF THE INVENTION

The invention provides a marine vehicle comprising a hull, a deck supported by the hull, and a seat including an L-shaped bracket including a generally horizontal portion having an upper surface, and a generally vertical portion having a front surface, a seat bottom member including a bottom surface connected to the upper surface of the horizontal portion, a seat back member including a back surface connected to the front surface of the vertical portion, and means for mounting the bracket on the deck.

The invention also provides a marine vehicle comprising a hull, a deck supported by the hull, a seat including a seat bottom member including opposite first and second sides, and a top surface, a seat back member including opposite first and second sides, an upper end, and a front surface, a first seat bottom side wing extending upwardly from the seat bottom member and including a top end, and a bottom end removably connected to the top surface of the seat bottom member adjacent the first side of the seat bottom member, a second seat bottom side wing extending upwardly from the seat bottom member and including a top end, and a bottom end removably connected to the top surface of the seat bottom member adjacent the second side of the seat bottom member, a first seat back side wing extending forwardly from the seat back member and including a front end, and a back end removably connected to the front surface of the seat back member adjacent the first side of the seat back member, and a second seat back side wing extending forwardly from the seat back member and including a front end, and a back end removably connected to the front surface of the seat back member adjacent the second side of the seat back member, and means for mounting the seat on the deck.

The invention also provides a modular seat comprising an L-shaped bracket including a generally horizontal portion having an upper surface, and a generally vertical portion having a front surface and an upper end, a seat bottom member including opposite first and second sides, a top surface, and a bottom surface connected to the upper surface of the horizontal portion, a seat back member including opposite first and second sides, an upper end, a front surface, and a back surface connected to the front surface of the vertical portion, a first seat bottom side wing extending upwardly from the seat bottom member and including a top end, and a bottom end removably connected to the top surface of the seat bottom member adjacent the first side of the seat bottom member, a second seat bottom side wing extending upwardly from the seat bottom member and including a top end, and a bottom end removably connected to the top surface of the seat bottom member adjacent the second side of the seat bottom member, a first seat back side wing extending forwardly from the seat back member and including a front end, and a back end removably connected to the front surface of the seat back member adjacent the first side of the seat back member, a second seat back side wing extending forwardly from the seat back member and including a front end, and a back end connected to the front surface of the seat back member adjacent the second side of the seat back member, a first seat bottom bolster removably connected to and extending upwardly from the top end of the first seat back side wing, a second seat bottom bolster removably connected to and extending upwardly from the top end of the second seat back side wing, a first seat back bolster removably connected to and extending forwardly from the front end of the first seat back side wing, a second seat back bolster removably connected to and extending forwardly from the front end of the second seat back side wing, and a headrest connected to the upper end of the vertical portion of the bracket and extending above the upper end of the seat back member.

The invention also provides a method for constructing a seat, the method comprising the steps of extruding metal to form a bracket having opposite first and second ends and being bent approximately 90° at a point intermediate the opposite first and second ends to form a vertical portion having a front surface, and a horizontal portion having an upper surface, providing a seat bottom member and a seat back member, connecting the seat bottom member to the upper surface of the horizontal portion, and connecting the seat back member to the front surface of the vertical portion.

A principal feature of the invention is the provision of a modular seat as set forth above. This seat permits many seat constructions, including a standard bucket seat, a reclining bucket seat, a convertible seat/bolster and a fishing seat. This seat is also very easy and inexpensive to manufacture.

Another principal feature of the invention is the provision of the above-described method for making a seat. This method is economical and produces a very functional seat, as explained above.

Other features and advantages of the invention will become apparent to those skilled in the art upon review of the following detailed description, claims and drawings.

Figure 1:
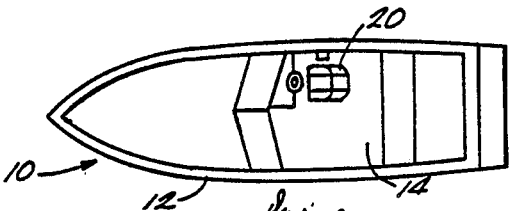
FIG. 1 is a plan view of a marine vehicle embodying the and including a modular seat.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine vehicle or recreational boat 10 embodying the invention is illustrated in the drawings. The boat 10 comprises a hull 12, a deck 14 supported by the hull 12, and a modular seat 20.

The seat 20 includes an L-shaped bracket 22 which is preferably an aluminum extrusion, which has opposite ends and which is bent approximately 90° at a point intermediate the ends to form a vertical portion 24 having a front surface and an upper end, and a horizontal portion 26 having an upper surface. The overall bracket 22 includes a generally planar main portion 28 having opposite first and second sides and a U-shaped recess 30 intermediate the sides. The bottom wall 32 of the recess 30 has therein transverse slots 34. The bracket 22 also includes a first transverse portion 36 extending transversely from the first side, a second transverse portion 38 extending transverse from the second side, a first parallel portion 40 extending generally parallel to the main portion 28 and inwardly from the first transverse portion 36, and a second parallel portion 42 extending generally parallel to the main portion 28 and inwardly from the second transverse portion 38. The first parallel portion 40 has an inner end 43 spaced from the main portion 28, and the second parallel portion 42 has an inner end 45 spaced from the main portion 28.

The main portion 28, the first transverse portion 36 and the first parallel portion 40 define a first inwardly opening slot 44, and the main portion 28, the second transverse portion 38 and the second parallel portion 42 define a second inwardly opening slot 46 opposed from the first slot 44. Preferably, the inner ends 43 and 45 of the parallel portions 40 and 42 collapse toward the main portion 28 adjacent the point where the bracket 22 is bent. This adds strength to the bracket 22.

Figure 2:
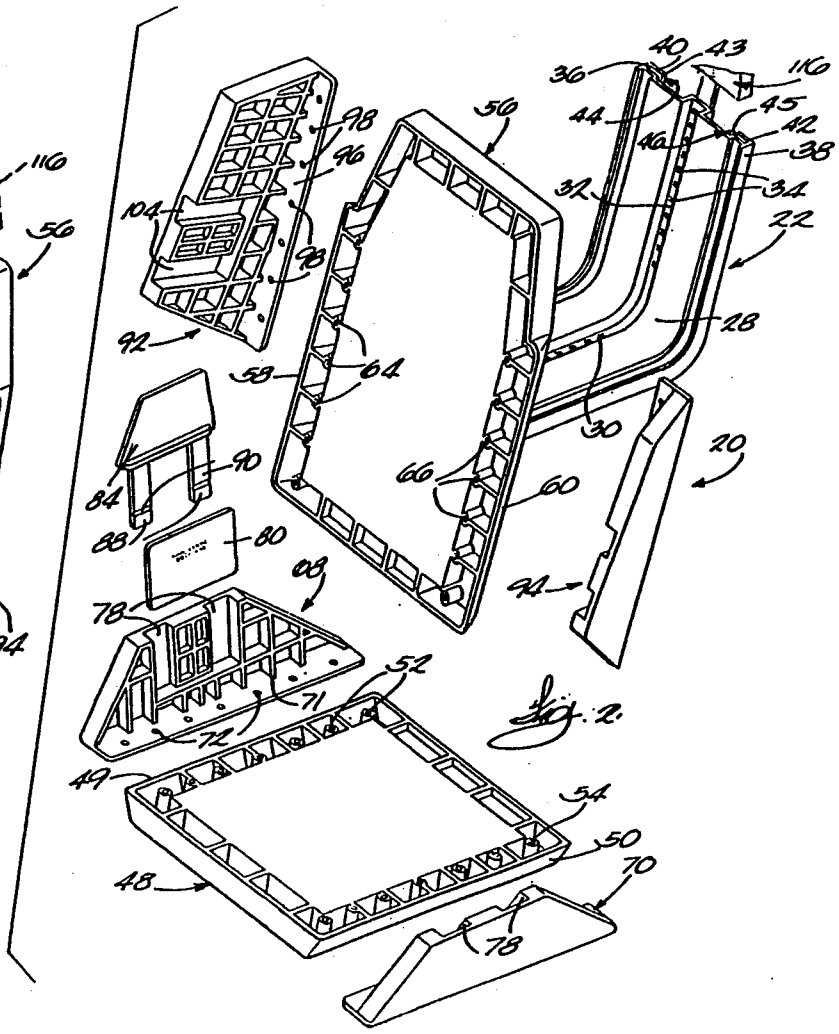
FIG. 2 is an exploded, partial, top perspective view o seat without cushions.
Figure 3:
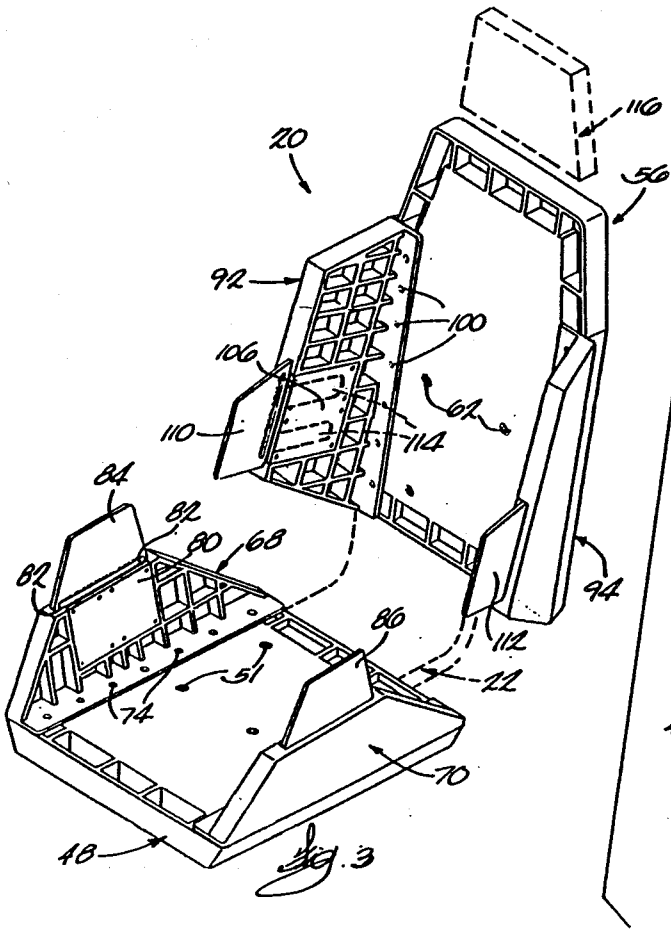
FIG. 3 is a partial, top perspective view of the seat without cushions.

The seat 20 also includes a seat bottom member 48 including opposite first and second sides 49 and 50, respectively, a top surface, and a bottom surface connected to the upper surface of the horizontal portion 26 of the bracket 22. The seat bottom member 48 can be connected to the bracket 22 by any suitable means such as screws or bolts 51. As shown in FIG. 2, the seat bottom member 48 has a ribbed or waffle-like construction and includes a row of integral, cylindrical bosses 52 adjacent the first side 49, and a row of integral, cylindrical bosses 54 adjacent the second side 50. The ribs provide a rigid but lightweight construction.

The seat 20 also includes a seat back member 56 including opposite first and second sides, 58 and 60, respectively, an upper end, a front surface, and a back surface connected to the front surface of the vertical portion 24 of the bracket 22. The seat back member 56 can be connected to the bracket 22 by any suitable means such as screws or bolts 62. The seat back member 56 also has a waffle-like construction and includes a first row of bosses 64 adjacent the first side 58 and a second row of bosses 66 adjacent the second side 60.

The seat 20 also includes first and second seat bottom side wings 68 and 70, respectively, extending upwardly from the seat bottom member 48 and each including top and bottom ends. The bottom end of each wing 68 or 70 has thereon a flange portion 71 having therein a row of apertures 72 aligned with a respective row of bosses 52 or 54. The first wing 68 is removably connected to the top surface of the seat bottom member 48 adjacent the first side 49 thereof by screws or bolts 74 extending through the apertures 72 and into the bosses 52. The second wing 70 is removably connected to the seat bottom member 48 adjacent the second side 50 thereof by screws or bolts (not shown) extending through the apertures 72 and into the bosses 54.

Each wing 68 or 70 has therein a pair of parallel recesses 78. A plate 80 covers the recesses 78, except for the upper ends thereof, to provide in the top end of the wing 68 or 70 a pair of openings 82. The plate 80 can be secured to the wing 68 or 70 by any suitable means. The plate 80 has thereon projections (not shown) extending into the recesses 78.

The seat 20 also includes first and second seat bottom bolsters or bolster inserts 84 and 86, respectively. The first bolster 84 extends upwardly from the top end of the first wing 68, and the second bolster 86 extends upwardly from the top end of the second wing 70. Each bolster 84 or 86 includes downwardly extending projections 88 removably housed in the openings 82. Each projection 82 has therein a depression 90 that releasably engages a projection on the plate 80 to secure the bolster 84 or 86 to the wing 68 or 70.

The seat 20 also includes first and second seat back side wings 92 and 94, respectively, extending forwardly from the seat back member 56 and each including front and back ends. The back end of each wing 92 and 94 has thereon a flange portion 96 having therein a row of apertures 98 aligned with a respective row of bosses 64 or 66. The first wing 92 is removably connected to the seat back member 56 adjacent the first side 58 thereof by screws or bolts 100 extending through the apertures 98 ad into the bosses 64. The second wing 94 is removably connected to the seat back member 56 adjacent the second side 60 thereof by screws or bolts (not shown) extending through the apertures 98 and into the bosses 66.

Each wing 92 or 94 has therein recesses 104 similar to the recesses 78 in the bottom wings 68 and 70, and a plate 106 similar to the plates 80 covers the recesses 78.

The seat 20 also includes first and second seat back bolsters or bolster inserts 110 and 112, respectively. The first bolster 110 extends forwardly from the front end of the first wing 92, and the second bolster 112 extends forward from the front end of the second wing 94. Each bolster 110 or 112 includes projections 114 which are similar to the projections 88 on the bottom bolsters 84 and 86 and which removably secure the bolsters 110 and 112 to the wings 92 and 94 in a similar manner.

The seat 20 also includes a headrest 116. The headrest 116 includes a cushion 118 and an elongated support member 120 extending downwardly from the cushion 118. The lower end of the support member 120 has thereon a plate 122 having opposite first and second sides slidably housed in the slots 44 and 46, respectively. A bracket 124 also slidably secures the support member 120 to the back of the vertical portion 24 of the bracket 22. Means are provided for releasably securing the headrest 116 to the bracket 22 and for permitting adjustment of the vertical position of the headrest 116. While various suitable means can be employed, in the preferred embodiment, this means includes a locking member 126 having thereon a projection (not shown) that is removably locatable in the slots 34 on the vertical portion 24 of the bracket 22.

The seat 20 also includes means for mounting the bracket 22 on the deck 14. While various suitable means can be used, in the preferred embodiment, this means includes a conventional pedestal 128 that permits both pivotal and forward and rearward movement of the bracket 22 and thus of the seat 20. The pedestal 128 includes a projection (not shown) that is removably locatable in the slots 34 in the horizontal portion 26 of the bracket 22 to secure the seat 20 in the forward and rearward direction.

Figure 6:
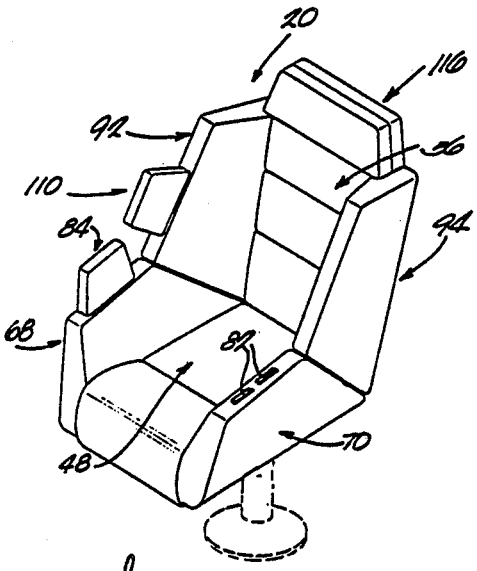
FIG. 6 a top perspective view of the seat.
Figure 4:
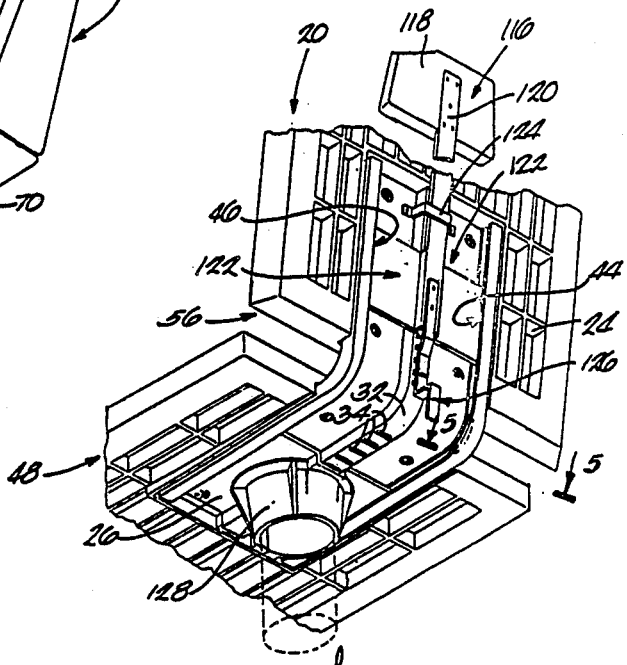
FIG. 4 is a partial, bottom perspective view of the seat without cushions.
Figure 5:
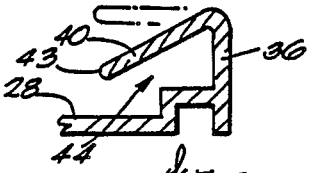
FIG. 5 is a view taken along line 5—5 in FIG. 4.

The seat 20 also includes padding or cushions on all of the seat bottom member 48, the seat back member 56, the sea bottom side wings 68 and 70, the seat back side wings 92 and 94, the bottom bolsters 84 and 86 and the back bolsters 110 and 11.. This is shown in FIG. 6.

All of the bolsters 110 and 112, the bolsters 84 and 86, the seat back side wings 92 and 94, the seat bottom side wings 68 and 70 and the headrest 116 can be removed in various combinations to provide various seat constructions. Also, the bracket 22 can be hinged as disclosed in the above-mentioned application Ser. No. 216,808, filed July 8, 1988, which is hereby incorporated herein by reference. Thus, the disclosed seat construction can be used to form both a convertible seat/bolster, as disclosed in the above-incorporated application, or a reclining bucket seat. Also, various types of arrangements can be used for mounting the bracket 22 on the deck 14.

Various features of the invention are set forth in the following claims.

We claim:

1. A marine vehicle comprising a hull, a deck supported by said hull, and a seat including an L-shaped bracket comprising an elongated extruded member of constant cross section transverse to the length thereof and having at least one reinforcing rib extending lengthwise thereof and including a generally horizontal portion having an upper surface, and a generally vertical portion having a front surface, a seat bottom member including a bottom surface connected to said upper surface of said horizontal portion, a seat back member including a back surface connected to said front surface of said vertical portion, and means for mounting said bracket on said deck.

2. A marine vehicle comprising a hull, a deck supported by said hull, a seat including a seat bottom member including opposite first and second sides, and a top surface, a seat back member including opposite first and second sides, an upper end, and a front surface, a first seat bottom side wing extending upwardly from said seat bottom member and including a top end, and a bottom end removably connected to said top surface of said seat bottom member adjacent said first side of said seat bottom member, a second seat bottom side wing extending upwardly from said seat bottom member and including a top end, and a bottom end removably connected to said top surface of said seat bottom member adjacent said second side of said seat bottom member, a first seat back side wing extending forwardly from said seat back member and including a front end, and a back end removably connected to said front surface of said seat back member adjacent said first side of said seat back member, and a second seat back side wing extending forwardly from said seat back member and including a front end, and a back end removably connected to said front surface of said seat back member adjacent said second side of said seat back member, and means for mounting said seat on said deck.

3. A modular seat comprising an L-shaped bracket including a generally horizontal portion having an upper surface, and a generally vertical portion having a front surface and an upper end, a seat bottom member including opposite first and second sides, a top surface, and a bottom surface removably connected to said upper surface of said horizontal portion, a seat back member including opposite first and second sides, an upper end, a front surface, and a back surface removably connected to said front surface of said vertical portion, a first seat bottom side wing extending upwardly from said seat bottom member and including a top end, and a bottom end removably connected to said top surface of said seat bottom member adjacent said first side of said seat bottom member, a second seat bottom side wing extending upwardly from said seat bottom member and including a top end, and a bottom end removably connected to said top surface of said seat bottom member adjacent said second side of said seat bottom member, a first seat back side wing extending forwardly from said seat back member and including a front end, and a back end removably connected to said front surface of said seat back member adjacent said first side of said seat back member, a second seat back side wing extending forwardly from said seat back member and including a front end, and a back end connected to said front surface of said seat back member adjacent said second side of said seat back member, a first seat bottom bolster removably connected to and extending upwardly from said top end of said first seat back side wing, a second seat bottom bolster removably connected to and extending upwardly from said top end of said second seat back side wing, a first seat back bolster removably connected to and extending forwardly from said front end of said first seat back side wing, a second seat back bolster removably connected to and extending forwardly from said front end of said second seat back side wing, and a headrest connected to said upper end of said vertical portion of said bracket and extending above said upper end of said seat back member.

4. A modular seat as set forth in claim 3 wherein said bracket includes a generally planar main portion having an opposite first and second sides, a first transverse portion extending transversely from said first side of said main portion, a second transverse portion extending transversely from said second side of said main portion, a first parallel portion extending generally parallel to said main portion and inwardly from said first transverse portion, said first parallel portion having an inner end spaced from said main portion, a second parallel portion extending generally parallel to said main portion and inwardly from said second transverse portion, said second parallel portion having a inner end spaced from said main portion, said main portion, said first transverse portion and said first parallel portion defining a first inwardly opening slot, and said main portion, said second transverse portion and said second parallel portion defining a second inwardly opening slot opposed from said first slot.

5. A modular seat as set forth in claim 4 wherein said bracket is a metal extrusion having opposite first and second ends and being bent approximately 90° at a point intermediate said opposite first and second ends to form said vertical portion and said horizontal portion, and wherein said inner ends of said first and second parallel portions are collapsed toward said main portion adjacent said point.

6. A method for constructing a seat, said method comprising the steps of extruding metal to form a bracket comprising an elongated member of constant transverse cross section throughout the length thereof and having opposite first and second ends and being bent approximately 90° at a point intermediate said opposite first and second ends to form a vertical portion having a front surface, and a horizontal portion having an upper surface, providing a seat bottom member and a seat back member, directly connecting said seat bottom member to said upper surface of said horizontal portion, and directly connecting said seat back member to said front surface of said vertical portion.

7. A seat including an L-shaped bracket comprising an elongated extruded member of constant cross-section transverse to the length thereof and having at least one reinforcing rib extending lengthwise thereof and including a generally horizontal portion having an upper surface, and a generally vertical portion having a front surface, a seat bottom member including a bottom surface connected to said upper surface of said horizontal portion, and a seat back member including a back surface connected to said front surface of said vertical portion.

8. A seat including a seat bottom member including opposite first and second sides, and a top surface, a seat back member including opposite first and second sides, an upper end, and a front surface, a first seat bottom side wing extending upwardly from said seat bottom member and including a bottom end removably connected to said top surface of said seat bottom member adjacent said first side of said seat bottom member, a second seat bottom side wing extending upwardly from said seat bottom member and including a bottom end removably connected to said top surface of said seat bottom member adjacent said second side of said seat bottom member, a first seat back side wing extending forwardly from said seat back member and including a back end removably connected to said front surface of said seat back member adjacent said first side of said seat back member, and a second seat side wing extending forwardly from said seat back member and including a back end removably connected to said front surface of said seat back member adjacent said second side of said seat back member.

* * * * *

UNITED STATES PATENT AND TRADEMARK OFFICE

CERTIFICATE OF CORRECTION

PATENT NO. : 4,869,551

DATED : September 26, 1989

INVENTOR(S) : Michael W. Lathers

It is certified that error appears in the above—identified patent and that said Letters Patent is hereby corrected as shown below:

The first page of the patent should indicate that the patent is assigned to Outboard Marine Corporation, Waukegan, IL.

In Claim 8, column 8, line 15, insert the word -- back -- after the word "seat".

Signed and Sealed this

Twenty-first Day of July, 1992

*Attest:*

DOUGLAS B. COMER

*Attesting Officer*

*Acting Commissioner of Patents and Trademarks*